US005367934A

United States Patent [19]

MacNiel

[11] Patent Number: 5,367,934

[45] Date of Patent: Nov. 29, 1994

[54] MEDIA CUTTER MECHANISM

[75] Inventor: Douglas K. MacNiel, Costa Mesa, Calif.

[73] Assignee: CalComp Inc., Anaheim, Calif.

[21] Appl. No.: 53,536

[22] Filed: Apr. 29, 1993

[51] Int. Cl.[5] ..... B26D 1/22

[52] U.S. Cl. ..... 83/425.2; 83/434; 83/505; 83/508.1; 83/564

[58] Field of Search ..... 83/425.2, 425.3, 425.4, 83/434, 508.1, 508.3, 505, 522.11, 522.15, 522.23, 563, 564, 602, 659, 858, 346; 101/226, 227, 228, 232, 224; 242/56.2, 56.3, 56.5; 250/231.1, 231.14

[56] References Cited

U.S. PATENT DOCUMENTS

| | | | |
|---|---|---|---|
| 3,935,776 | 2/1976 | Dingus | 83/425.4 |
| 3,944,150 | 3/1976 | Jennerjahn | 242/56.2 |
| 4,094,217 | 6/1978 | Exline | 83/563 X |
| 4,380,945 | 4/1983 | Guild et al. | 83/564 X |
| 4,537,582 | 8/1985 | Liu | 83/425.2 X |
| 4,570,518 | 2/1986 | Burmeister et al. | 83/508.3 X |
| 4,799,413 | 1/1989 | Soderqvist | 83/434 X |
| 4,942,795 | 7/1990 | Linke et al. | 83/72 |
| 4,951,891 | 8/1990 | Kozbur et al. | 242/56.2 |
| 5,111,724 | 5/1992 | Kanaga et al. | 83/434 X |
| 5,153,437 | 10/1992 | Nishii et al. | 250/231.14 |

*Primary Examiner*—Eugenia Jones

*Attorney, Agent, or Firm*—Frederic P. Smith; William F. Porter, Jr.

[57] ABSTRACT

A media cutter mechanism for a plotter in which the media is supported by a rotating support having one or more continuous recesses therein positioned to be at least partially covered by the media, the media being stationary with respect to the rotating support. One or more cutters are positioned external of the support and are movable a preselected distance into the recesses. Movers are provided for moving the cutters into the recesses to cut the media covering the recesses. In a particular embodiment, a plurality of individual cutters are employed and a plurality of commonly driven individual cams interact with the cutters for individually moving the individual cutters into the recesses. A controller is provided for controlling the individual cams to cut the media into preselected widths. In addition, a driver is provided for commonly driving the individual cutters.

9 Claims, 3 Drawing Sheets

SENSOR
PLOTTER CONTROL
FEEDER MECH.
PLOTTER CONTROL
FEEDER MECH.

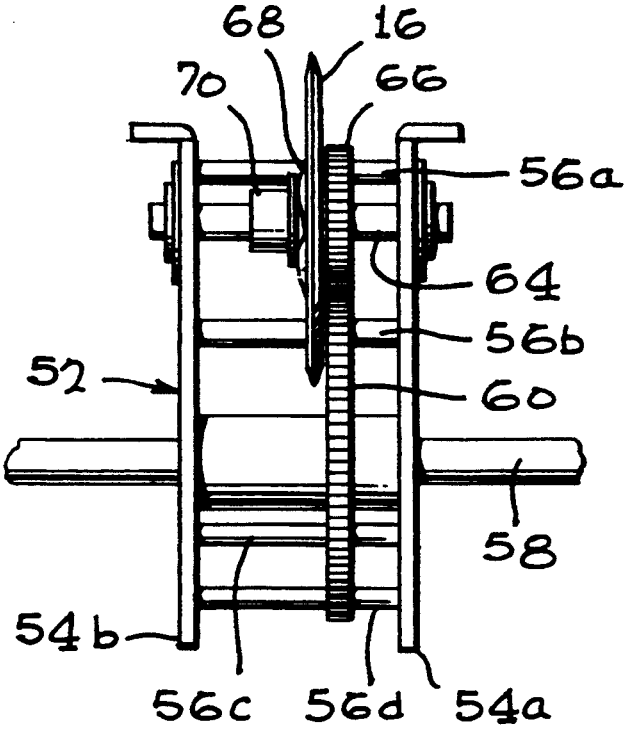
FIG. 5
FIG. 7
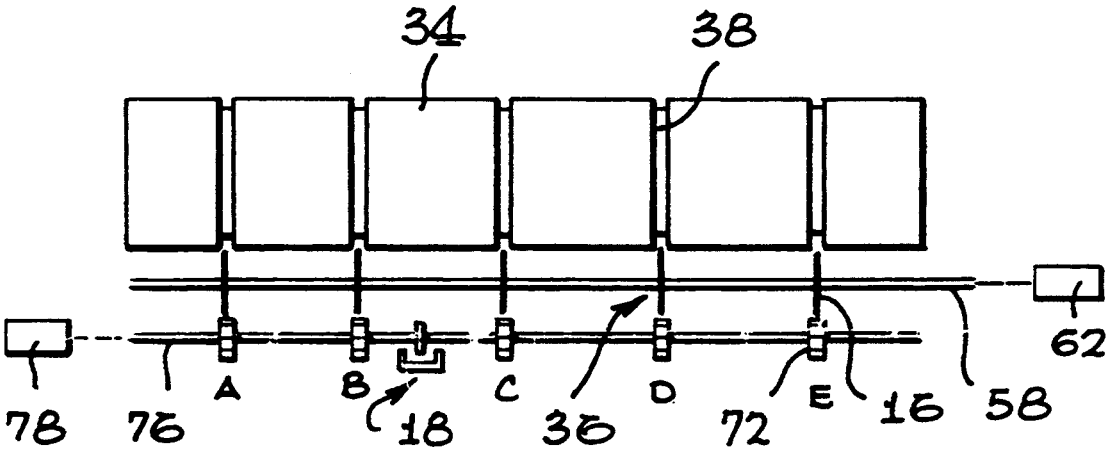

MEDIA CUTTER MECHANISM

BACKGROUND OF THE INVENTION

1. Field of the Invention

This invention relates to the field of plotters and, in particular, to a media cutter mechanism for a plotter which is able to cut within the plotter different widths of media from a continuous moving sheet of media.

2. Description of Related Art

In order to obtain the greatest versatility from plotters, plotters have been designed to accept a standard width of media, such as thirty-six inches, and then to produce a trace on the media corresponding to differing standardized lengths and widths of media, such as 8.5"×11", 17"×22", etc. While it is fairly easy to crosscut the media for any desired length, considerable difficulties have been encountered in developing methods and equipment which will accurately, quickly and inexpensively cut varying widths of media. For example, one such method involves the use of a flat platen external of the plotter with multiple parallel slots in it. The media coming out of the plotter is pulled across the platen and a desired combination of individual cutter blades, each with its own motor, is lowered, by deactivating a corresponding combination of individual solenoids, into the slots in the platen to produce the desired width of media. When the cutting operation is completed, the individual solenoids are activated to retract the motors and cutter blades. In addition to the apparatus being extremely heavy and expensive, the sideways wander of the media over the flat platen rendered it impractical to cut media greater than 88" in length. Furthermore, since the media is pulled and cut external of the plotter, any cross cutting also had to be done external of the plotter.

Thus, it is a primary object of the present invention to provide an improved media cutter mechanism for a plotter.

It is another object of the present invention to provide an improved media cutter mechanism for a plotter which can cut selected media widths within the plotter itself.

It is a further object of the present invention to provide an improved media cutter mechanism for a plotter which can accurately cut continuous lengths of media into desired widths.

It is still another object of the present invention to provide an improved media cutter mechanism for a plotter which enables the media to be crosscut within the plotter itself.

It is a further object of the present invention to provide an improved media cutter mechanism for a plotter which is compact, accurate and low cost.

SUMMARY OF THE INVENTION

A media cutter mechanism for a plotter is provided in which the media is supported by a rotating support means having one or more continuous recesses therein positioned to be at least partially covered by the media, the media being stationary with respect to the rotating support means. One or more cutter means is positioned external of the support means and is adapted to be extended a preselected distance into the recesses. Means are provided for moving the cutter means into the recesses to cut the media covering the recesses. In a particular embodiment, a plurality of individual cutter means are employed and a plurality of commonly driven individual positioning means interact with the cutter means for individually moving the individual cutter means into the recesses. Means are further provided for controlling the individual positioning means to cut the media into preselected widths. In addition, means are provided for commonly driving the individual cutter means.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 5 is a front view of the cutter blade housing of the present invention taken along line 5—5 of FIG. 4.

FIG. 7 is a diagrammatic view of a plurality of cutter blades illustrating the width cutting capability of the present invention.

DESCRIPTION OF THE PREFERRED EMBODIMENT

Figures 1, 2, 6:
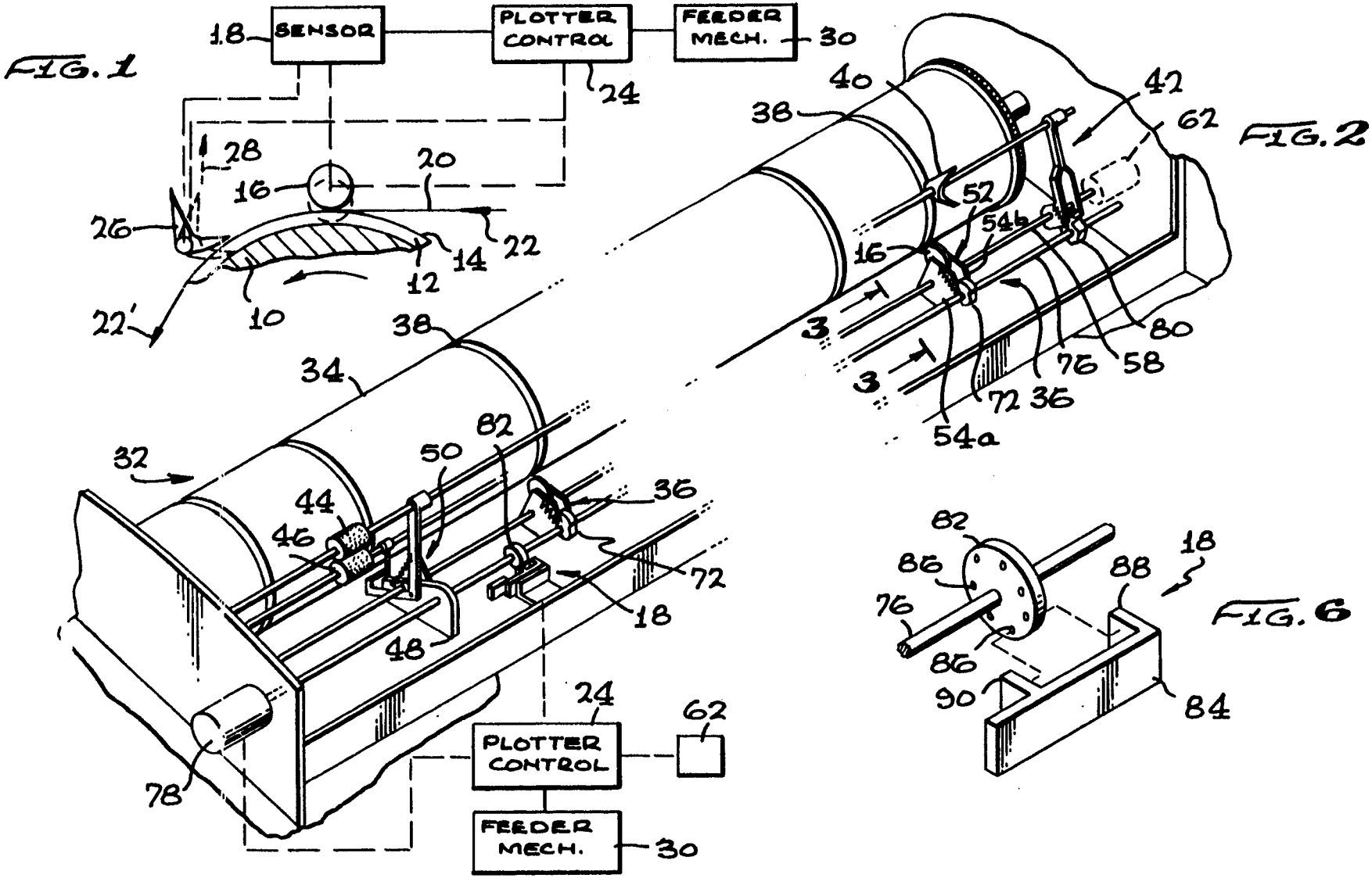
FIG. 1 is a simplified drawing illustrating the principle of operation of the present invention.
FIG. 2 is an isometric view of the present invention in its intended environment.
FIG. 6 is an exploded perspective view of the photooptic sensor of the present invention.

Referring now to FIG. 1, a roller 10 is shown having a continuous recess 12 in the surface 14 thereof. A cutter blade 16 is positioned above the surface 14 of the roller 10 and has a sensor 18 coupled thereto which detects the position of the cutter blade 16. The cutter blade 16 normally allows the media 20, travelling in the direction of the arrow 22, to pass thereunder and to be rolled up on the surface 14 of the roller 10, as indicated by arrow 22'. When it is desired to cut the media 20 into varying widths and strip or peel the media 20 from the surface 14 of the roller 16, plotter control 24, which receives a position signal from sensor 18, causes the cutter blade 16 to move into the recess 12, as shown in phantom, until the sensor 18 indicates that the cutter blade 16 has sufficiently moved into the recess 12 to cut the media 20 and sends a signal to plotter control 24 to stop further movement of the cutter blade 16. In addition, as described in my copending patent application, Ser. No. 08/054,339, filed Apr. 30, 1993, entitled "Media Stripper Mechanism", assigned to the same assignee as the assignee of the present invention and incorporated herein by reference, plotter control 24 causes a stripper blade 26, under which the media 20 normally passes, to be rotated, as shown in phantom, into the recess 12 down stream of the cutter blade 16 to strip the media 20 from the surface 14 of the roller 10 in the direction of the arrow 28. Prior to the movement of cutter blade 16 and rotation of the stripper blade 26, plotter control 24 also sends a signal to feeder mechanism 30 which stops the media 20 from being fed to roller 10 so that cutter blade 16 and stripper blade 26 can move into recess 12 before the media 20 arrives at the surface 14 of roller 10 and covers recess 12. When the cutter blade 16 and the stripper blade 26 are in operational position in the recess 12, plotter control 24 signals feeder mechanism 30 to feed the media 20 to the roller 10 where the media 20 now encounters the cutter blade 16 which cuts the media 20 and the stripper blade 26 which strips the media 20 from the surface 14 and guides and redirects it in the direction of arrow 28, as shown in phantom. In general, feeder mechanism 30 operates by clamping the media 20, cross cutting the media 20 at a desired length and then releasing the media 20 into a channel where it is picked up by rotating roller 10. Since the plotter feed is in continuous operation, the media 20 after the feeder mechanism 30 is temporarily held and slips on the roller 10 while the crosscut is made, when it then clears the roller 10, while the media 20 before the feeder mechanism 30 bunches up until it is released to the roller 10.

In FIGS. 2–7, the media cutter mechanism of the present invention is illustrated operating in its intended environment. A plotter 32 is shown having a takeup roller 34 which is driven either to roll up the media 20 or to support the media 20 for cutting by the cutter mechanism 36. The takeup roller 34 has a plurality of circumferential grooves 38 therein will cooperate with the cutter mechanism 36 to longitudinally cut the media 20 into selected widths. As described in my copending patent application, the circumferential grooves 38 also cooperate with stripper blades 40 and stripper mechanism 42 to strip the media off the takeup roller 34. Pinch rollers 44,46, supported by support 48 and support mechanism 50, along with a vacuum assist (not shown), keep media 20 in intimate contact with takeup roller 34.

Figure 3:
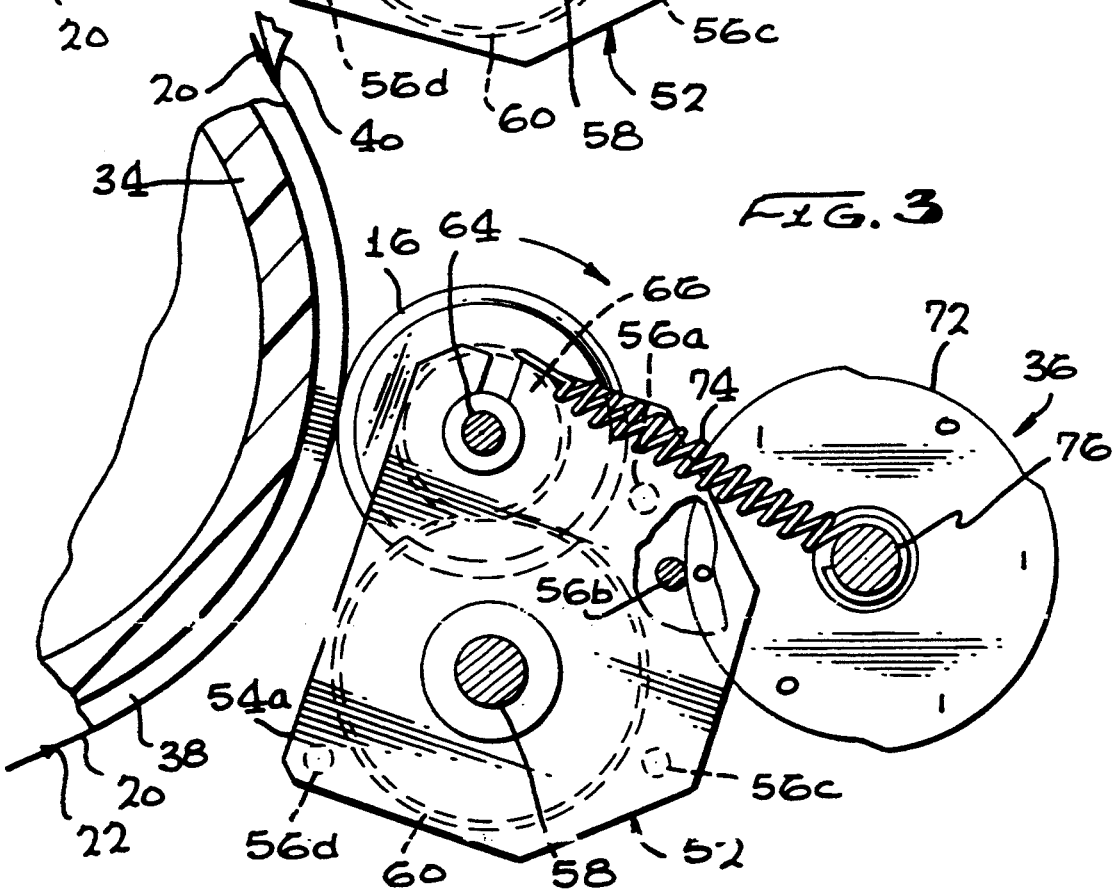
FIG. 3 is a cross-sectional view of FIG. 2 taken along line 3—3 of FIG. 2.

As shown in the Figures, the cutter mechanism 36 includes a cutter housing 52 consisting of two parallel plates 54 *a,b* spaced by swagged pins 56 *a,b,c,d*. Cutter housing 52 is mounted on shaft 58 and is rotatable around shaft 58. Gear 60 is coupled to shaft 58 and is driven by motor 62. Cutter housing 52 carries shaft 64 thereon upon which is mounted cutter blade 16, gear 66, spring 68 and collar 70. Gear 66 intermeshes with gear 60 and thus drives cutter blade 16 which is engaged to gear 66 by collar 70 and spring 68. As shown in FIGS. 2 and 3, cutter housing 52 engages cam 72 by pin 56*b* and spring 74. Cam 72 is mounted on camshaft 76 which is driven by motor 78, and is contoured to rotate cutter housing 52 towards the takeup roller 34 by means of pin 56*b*. Supports 48, only one of which is shown, support and space the shafts 58 and 76 along the length of the plotter 32, in addition to supporting the pinch rollers 44,46 and the stripper mechanism 42 carried by shaft 58. Shaft 76 also carries cam 80 used to operate the stripper mechanism 44 and disc 82 which forms part of sensor 18.

Figure 4:
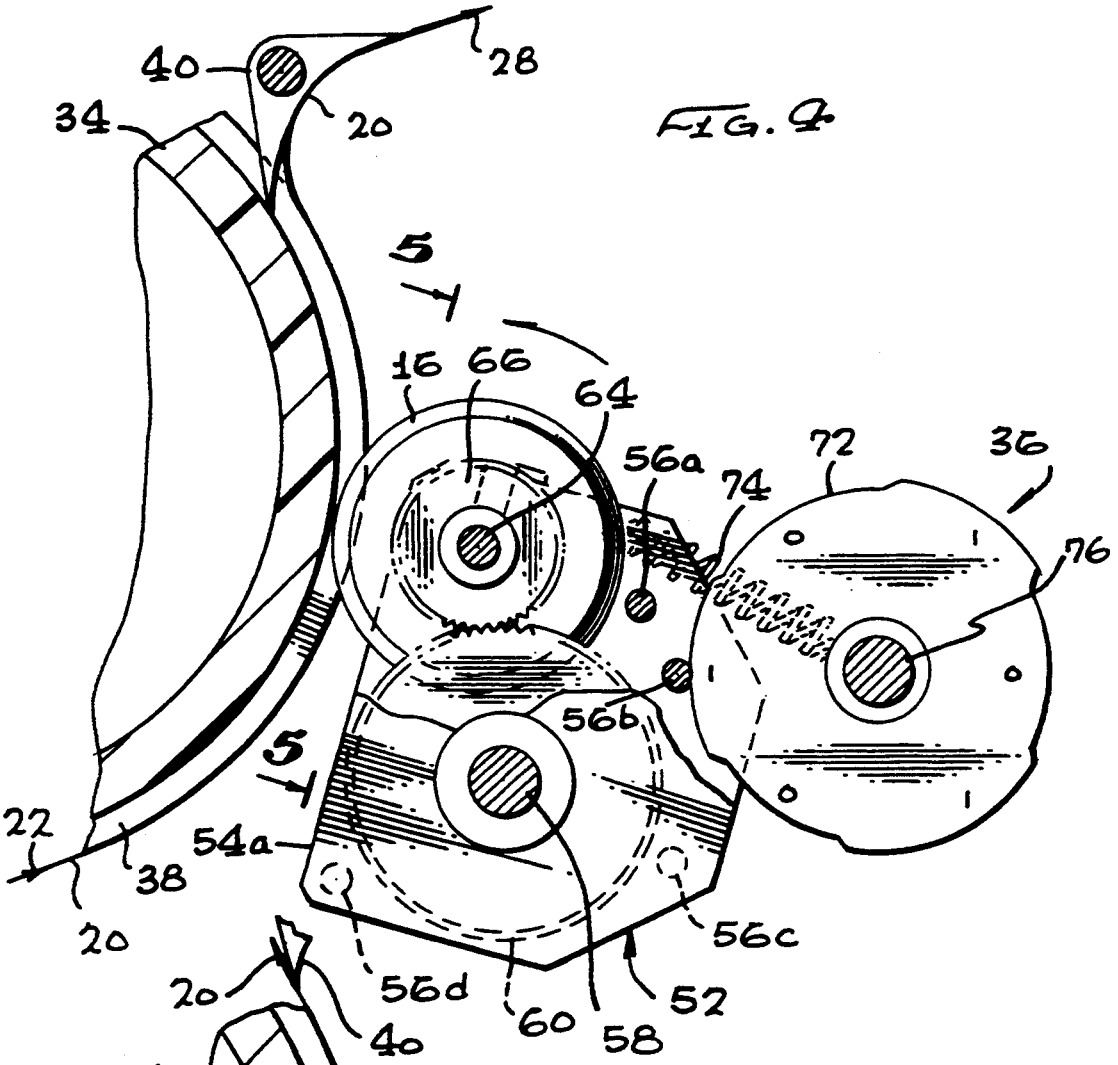
FIG. 4 is a cross-sectional view of FIG. 2 similar to FIG. 3 but showing the present invention in its operational mode.

In normal takeup operation, the media 20 approaches takeup roller 34 from bottom left (see FIG. 3), passes under the cutter blade 16 and the stripper blade 40 and proceeds to be rolled up on takeup roller 34, assisted by the pinch rollers 44,46 and the vacuum applied to the media 20 through holes in the takeup roller 34. When it is desired to cut the media 20 and to strip it from the takeup roller 34, plotter control 24 instructs feeder mechanism 30 to stop the flow of media 20 to the takeup roller 34. Plotter control 24 then instructs motor 62 to drive shaft 58 and the cutter blades 16 and motor 78 to rotate shaft 76 and cam 72 until the sensor 18 determines that the stripper blades 40 are in proper position and that the individual cutter housings 52 and cutter blades 16 are selectively in position. As can be seen in FIGS. 3 and 4, cam 76 is contoured so that upon rotation it causes pin 56*b* and thus housing 52 to travel to force cutter blade 16 into the recess 38 in the takeup roller 34. Spring 74 causes pin 56*b* to follow the contours of cam 76.

As seen in FIGS. 2 and 6, sensor 18 consists of a disc 82 and a member 84. The disc 82 has a plurality of holes 86 therein and is mounted on shaft 76, along with cams 72,80 and rotates between the two arms 88,90 of member 84, member 84 having a photodiode in one arm and a photodetector in the other arm and being coupled to plotter control 24. Thus plotter control 24 is able to determine the rotational position of shaft 76 by the passage of light through the holes 86 and thus the rotational positions of cams 72,80. While cam 80 is essentially a two position cam for operation of the stripper blades 40, cams 72, of which there are generally five designated A–E in FIG. 7, act to selectively insert and retract the five associated cutter blades 16A–E of the five cutter assemblies 36A–E. Cutter assemblies 36A,E are generally used to cut the selvage off the media 20 leaving, for example, a 34" width and thus cams 72A,E can be simple two position cams. Cutter assembles 36B,C,D cut the media 20 into various standard widths, such as 8½", 17" and 25½", or leave the media 20 at the 34" width. To accomplish this, the cams 72B,C,D must have contours yielding six combinations of cutter blade positions, namely (0,1,0,1,1,0), (0,1,1,0,0,0) and (0,1,0,1,0,1), where (1) represents an "in" position for a cutter blade 16 and (0) represents an "out" position, and must be rotated together in that relationship. Cam 72 in FIG. 4 has an appropriate cam 72D contour while cam 72 in FIG. 3 has an appropriate cam 72B contour. Since the disc 82 is shown as having six holes 86, the disc 82 can be keyed to correspond in position to the six positions of the cams 72 and thus sensor 18 can send a signal to plotter control 24 indicating the positions of the cutter blades 16.

When plotter control 24 receives a signal from sensor 18, indicating the stripper blade 40 and the appropriate cutter blades 16 are in position, plotter control 24 sends a signal to stop motor 78 and to instruct feeder mechanism 30 to send media 20 to the uptake roller 34. As seen in FIG. 4, after going partway around takeup roller 34, media 20 encounters one or more cutter blades 16 where media 20 is cut into a preselected width, or at least has the selvage cut off. Media 20 then encounters stripper blade 40 which proceeds to peel media 20 from the takeup roller 34 and guide and redirect the media 20 away from the takeup roller 34 in the direction of arrow 28. When it is no longer desired to cut and strip the media 20, plotter control turns off motor 62 and causes motor 78 to rotate shaft 76 a preselected amount, as determined by sensor 18. Cams 72,80 thus rotate back to their original positions and the spring-loaded cutter assemblies 36 and stripper mechanisms 42 return to their initial positions.

While the invention has been described with reference to a particular embodiment, it should be understood that the embodiment is merely illustrative as there are numerous variations and modifications which may be made by those skilled in the art. For example, the cutter blades need not rotate but can be stationary knifetype blades. In addition, the media can be plunge cut by the blades and thus the blades do not have to be inserted before the arrival of the media. Finally, under certain circumstances, the roller may remain stationary and the media pulled over the roller. Thus, the invention is to be construed as being limited only by the spirit and scope of the appended claims.

I claim:

1. A media cutter mechanism for a plotter comprising:

support means for supporting media, said support means having a plurality of recesses therein positioned to be at least partially covered by said media;

a plurality of individual cutter means positioned external of said support means, said cutter means being individually movable a preselected distance into said recesses and supported by a common shaft and pivotable therearound individually toward and away from said support means, each of said cutter means including a rotatable cutter blade and said common shaft being coupled to and driving each of said rotatable cutter blades, whereby said media can be selectively cut; and mover means for individually moving said cutter means into said recesses to cut said media covering said recesses.

2. The media cutter mechanism of claim 1 wherein said mover means includes cam means for moving said individual cutter means into said recesses, said cam means including a plurality of individual cams, each of said individual cams having a particular configuration for selectively moving a selected individual cutter means to cause said cutter means to selectively cut said media.

3. The media cutter mechanism of claim 2 wherein each of said individual cams is coupled to a common cam shaft in a selected position and is driven thereby.

4. The media cutter mechanism of claim 3 further comprising controller means for controlling the position of said common cam shaft to move selected ones of said individual cutter means into said recesses.

5. The media cutter mechanism of claim 4 further comprising sensor shaft for sensing the position of said cam means and for furnishing to said controller means a signal indicative of said position.

6. A media cutter mechanism for a plotter comprising:

support means for supporting a media, said support means having a plurality of recesses therein positioned to be at least partially covered by said media;

a plurality of individually movable cutter means positioned external of said support means and movable a preselected distance into said recesses;

a plurality of commonly driven individual positioning means for individually moving said individually movable cutter means into said recesses to selectively cut said media covering said recesses, said positioning means including a plurality of individual cams coupled to a rotatable common shaft in selected positions along said shaft, each of said cams having a particular configuration for selectively moving a selected individual movable cutter means, whereby upon rotation of said common shaft said particularly configured cams cause said selected cutter means to selectively cut said media; and controller means for controlling said rotation of said common shaft to move selected ones of said individually movable cutter means into said recesses.

7. The media cutter mechanism of claim 6 further comprising drive means for commonly driving said individually movable cutter means.

8. The media cutter mechanism of claim 6 wherein said individually movable cutter means are supported by a common shaft and are pivotable therearound individually toward and away from said support means.

9. The media cutter mechanism of claim 6 further comprising sensor means for sensing the position of said shaft and for furnishing to said controller means a signal indicative of said position.

* * * * *